United States Patent [19]

Sarver

[11] 4,007,946

[45] Feb. 15, 1977

[54] SHORT SKI

[76] Inventor: John Jeffery Sarver, 11 Carmel Bay Drive, Corona Del Mar, Calif. 92625

[22] Filed: Jan. 12, 1976

[21] Appl. No.: 648,140

[52] U.S. Cl. ..... 280/600; 280/607; 280/610

[51] Int. Cl.[2] ..... A63C 5/00

[58] Field of Search ..... 280/600, 601, 602, 609, 280/610, 617, 636, 18, 607

[56] References Cited

UNITED STATES PATENTS

| | | | |
|---|---|---|---|
| 1,512,327 | 10/1924 | Young, Jr. | 280/600 |
| 1,551,288 | 8/1925 | Denning | 280/600 |
| 2,242,156 | 5/1941 | Wallace | 280/601 |
| 2,929,636 | 3/1960 | Jones et al. | 280/600 |
| 3,295,859 | 1/1967 | Perry | 280/601 |
| 3,675,938 | 7/1972 | Sigl | 280/636 |
| 3,854,739 | 12/1974 | Toda et al. | 280/606 |
| D179,367 | 12/1956 | Allen et al. | 280/609 |

FOREIGN PATENTS OR APPLICATIONS

| | | | |
|---|---|---|---|
| 285,338 | 6/1915 | Germany | 280/609 |
| 127,546 | 2/1950 | Sweden | 280/601 |

*Primary Examiner*—Joseph F. Peters
*Assistant Examiner*—David M. Mitchell
*Attorney, Agent, or Firm*—Fulwider, Patton, Rieber, Lee & Utecht

[57] ABSTRACT

A pair of short skiis each comprising a flexible forward shovel section and a less flexible after section, the flexible shovel section including a substantially flat running portion and a leading turned up tip portion, the total running length of the ski being comprised of the running portion and the less flexible section. The boot location area on each ski is so disposed with reference to the total running length of the ski that the ball of the skier's foot is disposed at or slightly behind the approximate median of the ski's total running length. The flexible shovel section extends from just forward of said median. Binding means are provided to hold the skier's foot on each ski such that when the skier's boot is placed and held in said binding means, the heel of the skier's boot will be disposed approximately 6 inches forward of the tail end of the ski. These short skiis are intended for use by a skier employing the skiing technique wherein turning of the skiis is accomplished with the skier's weight at all times disposed no farther forward than the median of the running length and checking of the skiis may be accomplished by the skier's shifting most of his weight back from the balls of his feet to the heels thereof.

9 Claims, 8 Drawing Figures

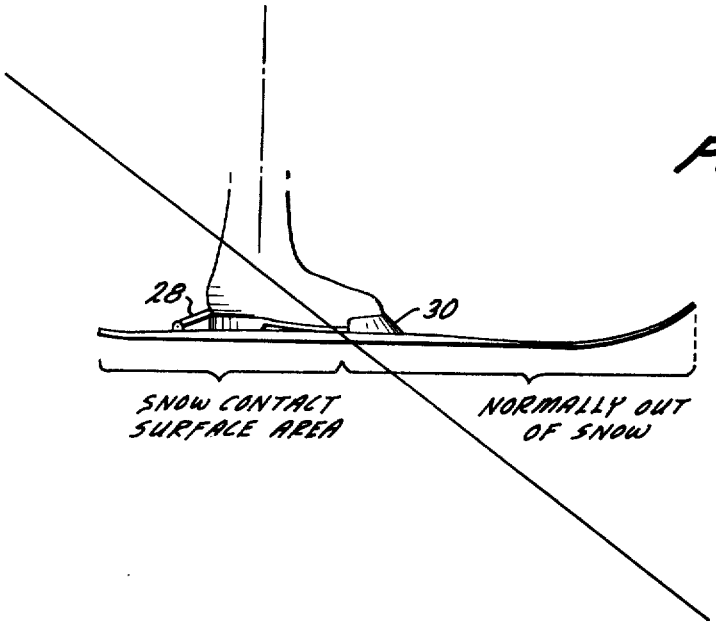
FIG. 1
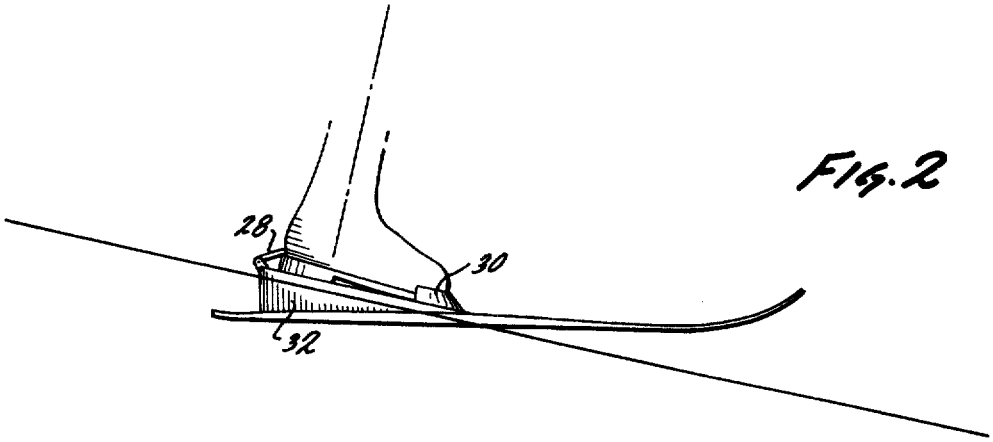
FIG. 2
FIG. 5
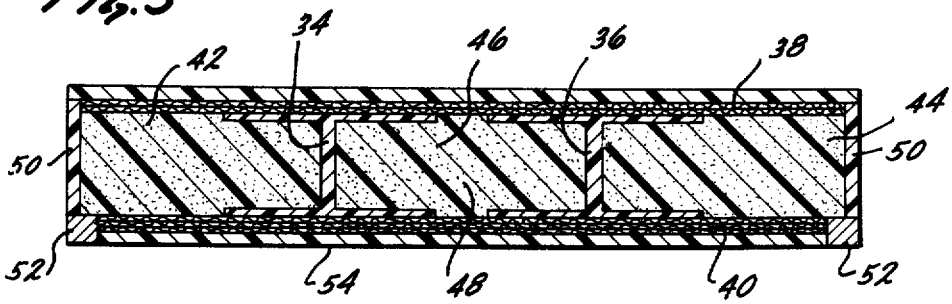

SHORT SKI

BACKGROUND OF THE INVENTION

1. Field Of The Invention

This invention relates broadly to snow skiing and particularly to a novel technique of snow skiing and skiing equipment whereby this novel technique may be practiced.

2. Description Of The Prior Art

Skiing was first seriously introduced into the United States in the 1930's by such famous European skiiers as Hannes Schneider. As originally taught, the skier, on skiis which were supposed to be of a length such that when the skier was standing with an arm raised the tip of the ski would at least reach the center of the palm of his raised hand; would be expected to carve heavy stem turns in the snow by shifting his weight to lean heavily initially on his uphill ski; and, as it came around in an arc across the fall line on the hill, the other ski would be brought around parallel to the thus-turned uphill ski after it had been thus shifted to become the downhill ski, and the skier would then redistribute his weight evenly on both skiis. This original skiing technique had been taught to European ski troops, each of the soldiers of which might be carrying a rifle and a weighty pack upon his back.

With interest in skiing in the United States being given some impetus by the return to civilian life after World War II of many American trained ski troops, skiing in the United States began to become increasingly popular and at an accelerated pace by the late 1950's. By this time, however, the original heavy stem turn technique had been largely abandoned in favor of the so-called "parallel" technique which, also, had been introduced into this country from Europe. However, even this parallel technique required many hours of learning by novice ski aspirants because of the size of the skiis which such aspirants were recommended to purchase. The ever increasing popularity of skiing in the United States during the 1960's and 1970's has produced a number of innovations and efforts to short-cut what was once a fairly difficult learning process. Many schools have attempted to eliminate the elemental step, so long taught, of learning to snow plow, followed by learning the stem turn and then, subsequently, the parallel turn. Also and in order to enable beginners more rapidly to learn the parallel technique, the lengths of the skiis have been gradually diminishing from what once may have been as great as 7 feet 6 inches, downwardly to the "short ski" which can be of a length no more than 100 centimeters. Among the most popular of such short skiis is that made by "Elan" and which goes under the designation "GLM", and acronym of the term "Graduated Length Method". Such skiis and the teaching method by which they are employed are described in a publication entitled "Ski Pure Parallel In A Day", prepared by the Special Marketing Division of Dell Publishing Co., Inc. and copyrighted in 1970 and 1971 by Universal Publishing and Distributing Corporation. These short skiis, however, are essentially "mini" length skiis of the standard long ski construction. They are intended essentially as stepping stones for beginners learning directly the parallel technique. Thus, after the skier has mastered turning on 100 centimeter length skiis, he or she is moved next to skiis of 120 centimeters in length; subsequently to 150 centimeter length skiis; and finally to skiis of 170 centimeters in length. Presumably with 170 centimeter length skiis, the skier may go on, should he or she so desire, to skiis up to 210 centimeters in length. All of these GLM skiis, however, as mentioned above, are constructed in the standard fashion, namely, with flexible forward and tail sections extending from a thicker and less flexible mid-section on which the skier's boot is mounted. Conventional skiis, moreover, are constructed in a slightly arched manner to provide what is termed "camber". In the parallel skiing technique, the turn is accomplished by a quick weight shift whereby the skier's weight is momentarily shifted to the forward portions of the skiis with the result that there is an unweighting of the tail portions and, in this momentary forward weight disposition, the skier is enabled to pivot both of his or her skiis presumably in parallel about points located toward the forward flexible areas of the skiis. As the turn is made, the side edges of the skiis tend to bite into the snow thereby enabling the skier to carve an arc in the snow which constitutes the desired turn or change in direction of travel. Where the snow is packed but not icy, it is relatively easy for skiers to make turns utilizing this technique. However, when snow conditions are not so ideal for parallel skiers, as for example, with heavy or sticky snow, breakable crust or even deep snow, properly controlled turns and other maneuvers may require a much higher degree of skill than is normally attained by those who may only ski no more than two or three weeks a year. The more advanced skier may sometimes employ an "ankle swivel" turn whereby under certain heavy snow and terrain conditions he is able to force turn his skiis. This, however, may require considerable strength and a high degree of coordination because the skier is actually forcing the long tip and long tail sideways across or through deep snow and must overcome the resistance to such movement.

Within the last few years certain advanced skiers have adopted a technique termed "hot dogging" in which, instead of shifting weight forward in the conventional manner, the skier tends to sit back so that his weight becomes disposed on the rear portion of his skiis during at least part of the turn. The skier does not, however, remain in this position throughout the complete turn but only in setting up the turn initially. As soon as the skier has begun pushing his skiis in front of his center of gravity to cause a change of direction, the skier quickly moves his weight forward over the center of the ski to check his speed, control his turn, and prepare for the next turn. This hot dogging technique, however, puts the skier in a very unstable position and requires a high degree of skill to execute proper turns. This is because when the skier's weight is placed toward the back half of the skiis, the skiis tend to move out forward of the skier and get away from him, with the result that he must be prepared to cause his center of gravity to catch up with the skiis as they move forward away from his vertical body line. In any event, it is difficult for even the more skilled skiers to execute hot dogging turns with long skiis in deep powder snow, heavy snow, or snow covered with breakable crust.

In addition to the GLM short skiis heretofore discussed, the present inventor has noted the following patents which disclose and claim some type of a short ski or ski board:

| Patent No. | Inventor | Date of Issue |
|---|---|---|
| 3,374,003 | J. L. Fulson | March 19, 1968 |
| 3,655,211 | J. Bollettieri & Arnedalen (deceased) | April 11, 1972 |
| 3,854,739 | Takashi Toda et al | December 7, 1974 |

All three of these patents, however, appear to be principally directed to providing some type of play ski for children and not any type of ski, such as the present invention, for serious adult or other advanced skiers. Moreover, none of such skiis would appear to be adaptable for use in skiing according to the technique which is contemplated for skiis constructed in accordance with the present invention.

SUMMARY OF THE INVENTION

Skiis constructed in accordance with the present invention are specially designed to enable the skier to practice a new skiing technique. This technique may be easily mastered and enables the skier to ski in deep powder snow, heavy snow and breakable crust, particularly when such snow conditions are found on the steeper slopes. The reason for this capability of the skier employing skiis constructed in accordance with the present invention is that, instead of the skier being expected to make his turn with his weight, at some time or another shifted over the tips of his skiis, it is intended that at all times the center of gravity of the skier will be maintained no farther forward than the median of the ski running length and, indeed, it will usually be maintained rearwardly of that median toward the tail ends of the skiis. Thus, the skiis will assume an angle of attack with respect to the surface of the snow, so that a substantial part of the running surface of the ski forward of the median of the running length will actually project out of the snow surface, while the tail of the ski will ride correspondingly deep in the snow. In this orientation, a relatively short length of each of the side edges of the skiis will actually be in contact with the snow surface. Thus, if this surface should be breakable crust, only a small portion of such crust will be in contact with the side edges of each ski so that turning in such breakable crust will be only minimally inhibited. It is well known among the experienced skiers that breakable crust is to be avoided at all cost with the long conventional skiis since it is almost impossible to make any conventional turn in snow in that condition. Similarly, in heavy, wet snow and in deep powder, the average skier employing the conventional parallel ski technique is almost certainly bound to be spilled when he attempts to make any turn.

It is a feature of skiis constructed in accordance with the present invention that each ski is comprised of a flexible forward shovel section and a less flexible after section. The flexible shovel section will include a substantially flat running portion which is preceded by a leading turned up tip portion. The total running length of the ski will be comprised of the combined lengths of the running portion of the flexible forward shovel section and the total length of the less flexible section. The boot location area on each ski is so disposed with reference to the total running length of the ski that the ball of the skier's foot will be disposed at the approximate median of the ski's total running length and the flexible shovel section will extend from just forward of that median. Binding means, of course, are provided to releasably hold the skier's foot on each ski in the foot location area. The total length of each ski is such, however, that when the skier's boot is placed and held in said binding means on the foot location area, where the skier is an adult male, the heel of his boot will be disposed only some 6 inches forward of the tail end of the ski. With the average adult size ski boot, then, the total length of the ski when the foregoing parameters are met, will be somewhere between 90 and 110 centimeters in length. However, because almost all of the skier's weight, when the skier is utilizing the technique for which these skiis are specially designed, will be carried by that portion of the ski between the tail end and the median of the ski's running length, it is desirable that the area of at least that weight carrying portion of each ski be maximized by a width which is substantially greater than the width of conventional skiis. Desirably also the flexible forward shovel section may be even wider than the rigid after section and this can be accomplished by slightly tapering the skiis inwardly back from the turned up portion of their forward shovel sections. Such widening, however, should not be so extensive as to prevent the skier from keeping his boots close enough together during ski running to prevent the skier from maintaining his skiis parallel and almost as close together as the skier would be able to do with conventional length and configured skiis, in order to accomplish turning of the skiis by appropriate shifting of the skier's weight on his skiis.

The greater flexibility of the forward shovel section of the ski enables the ski to absorb shock and impact of irregular snow and surfaces to carve turns. While the increased rigidity of the less flexible after section of each ski, commencing at least by the median of the total running length, at which median the ball of the foot of the skier is located, enables the skier to utilize the more rigid after section as a break or speed control as well as providing an effective tail edge to enable the skier to change his direction of travel. Desirably, also, the tail of the ski should be sufficiently stiff to enable edge control to be maintained since, because of the relatively short length of the ski, such edge control might otherwise be lost. In this connection, it may be desirable to provide metallic reinforcement plates on the heels of the skiis to resist the severe wearing forces which develop when the skiis are used with the heel braking technique. To these plates can be added sharp runners that would slice through ice.

Because the rigid after section of the ski will ride more deeply in the snow and plays a far more important role in the turning process in the skiing technique for which these skiis are designed, control performance may be improved by providing either deeper grooves than are normally found in conventional skiis, tapering grooves, or even small skag-like projections which may extend from some point below the foot location area to or at least toward the tail end of the ski. On the other hand, the skiis may be made and used successfully without any grooves or projections at all in their heel areas.

While it is possible to configure the ski with some type of narrower waist in the vicinity of the foot location area, it is more desirable to avoid providing any such waist in the ski configuration but, instead, to provide a gradual slightly widening taper outwardly from the tail toward the tip.

Since the skier utilizing the novel technique for which the skiis of the present invention are designed will normally be running down particularly steep hills at a fairly substantial angle of attack in relation to the surface of the snow on the hill (i.e., the tail sections of the skiis will be dug in to the deep snow), this places a strain on the skier to maintain the desired amount of tail pressure without experiencing undue fatigue in his legs. To assist the skier in this respect, it is also a feature of the present invention, although not a necessary one, to provide an angular wedge in conjunction with the ski bindings whereby the heel of the skier's boot is elevated with respect to the tip of the boot on the ski. This can be accomplished by means of a permanent wedge, or by means of an adjustable elevating member whereby the angle of the skier's boot with respect to the after section of the ski may be changed to best suit the skier. By providing such an angle to the skier's boot, the heel pressure may be better applied to the after section of the ski from an upright position and with greater force. In the absence of such a boot angle, the skier may be forced almost to sit backwards on his skiis in the manner of a hotdogger with the result that the skier may become more easily tired and actually not be able to control his skiis in the best manner. Also, when the skier's boot is elevated at the heel in the manner which would be provided by a suitable wedging of the shoe with respect to the after section of the ski, the skier may increase the angle of attack of his skiis with respect to the snow surface. In this manner the skier will be placed in a more high performance stance so that he will tend to bend his knees, lower his center of gravity and thereby be enabled to ski more aggressively. A further advantage which is obtained by elevating the skier's boot with respect to the ski, lies in the fact that the most advantageous pressure points in skiing, according to the technique for which the skiis of the present invention are designed, are the ball of the foot pivot and the heel pressure points. When forward pressure is applied by the skier during skiing, such pressure is transmitted via the ball of his foot to the ski, so that the skier's weight is then distributed at that particular predetermined pivot point spot. This provides the ski with equal torsional pressure tip and tail to enable the skier to turn in balance. However, should the skier's weight be applied at the heels, as would be the most common weight distribution for skiing these skiis, the ski tips will raise and the tail edge will lower thus becoming a very effective tool in "braking" and "turning". In such a manner with the weight back, these skiis can, under certain snow conditions, be skied on the tails with greater than 90% of their running surfaces raised out of the snow. The skier thus is afforded much greater and more predictable control over his skiis and ski technique.

BRIEF DESCRIPTION OF THE DRAWINGS

In the accompanying drawings:

FIG. 1 is a side elevation of a ski of the present invention illustrating how it might be utilized on a steep slope with deep snow;

FIG. 2 is a view similar to that of FIG. 1, but showing the inclusion of a wedge-type block on the ski, and illustrating its use on a slope of lesser steepness;

FIG. 5 is a section taken on the line 5—5 in FIG. 3 and looking in the direction of the arrows;

DESCRIPTION OF THE PREFERRED EMBODIMENTS

Figures 3, 4, 6, 7, 8:
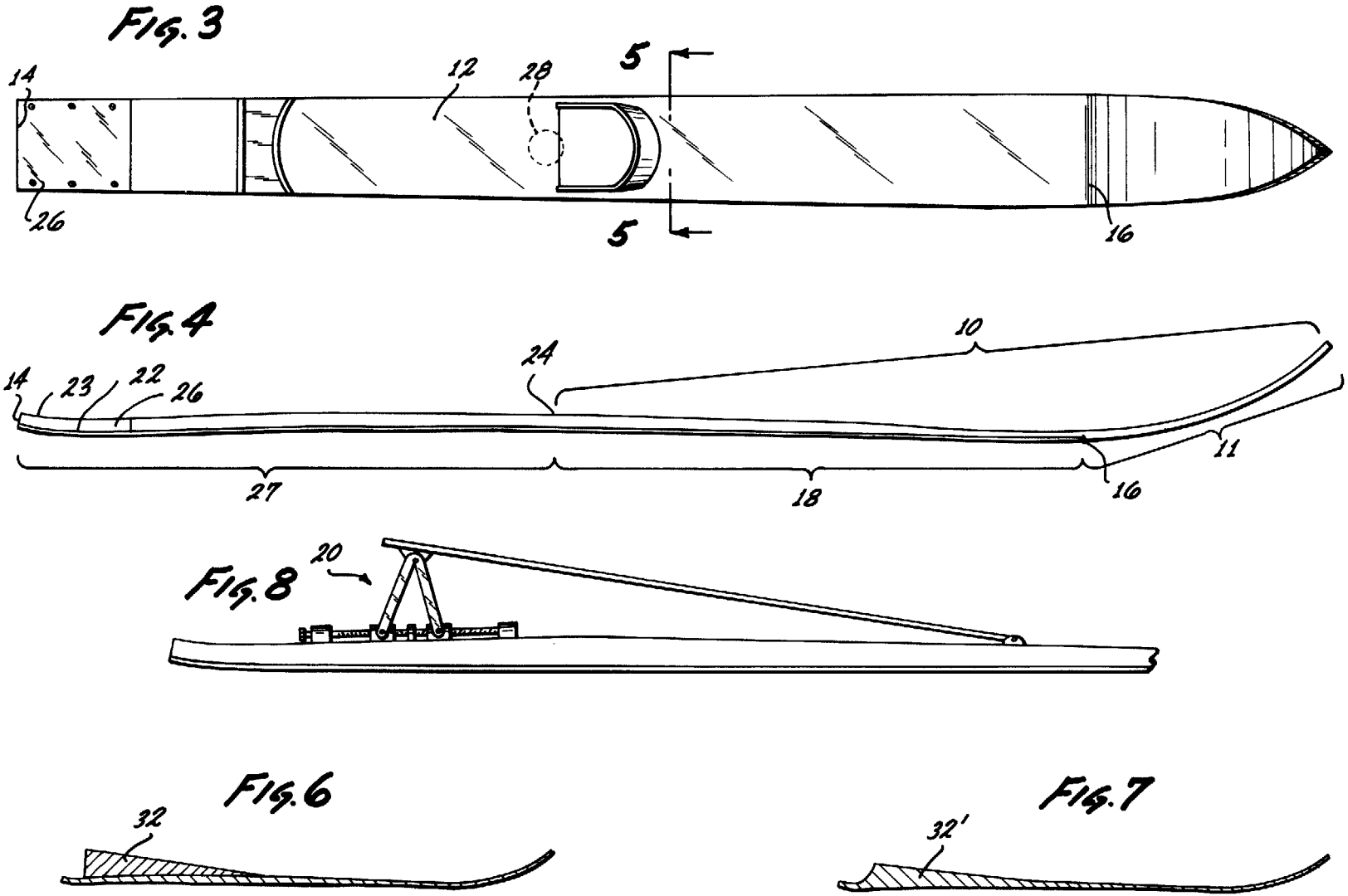
FIG. 3 is a plan view of one embodiment of a ski constructed in accordance with the present invention.
FIG. 4 is a side elevation of the ski shown in FIG. 3.
FIG. 6 is a longitudinal section taken from the side of the embodiment of the invention shown in FIG. 2.
FIG. 7 is a similar longitudinal section, but of a different embodiment of the present invention.
FIG. 8 is a side elevation of a ski with a height adjustable binding.

Referring first to FIGS. 3 and 4 of the drawings, a ski constructed in accordance with the present invention may appear at first blush to resemble a conventional ski. There are, however, a number of differences, namely:

In the first place, the overall length of the ski would range between 90 and 110 centimeters with the binding being positioned to place the heel of the boot about 6 inches from the back end of the skiis.

Secondly, because of this relatively short length, in order to provide for an adequate distribution of the skier's weight, particularly on soft snow, the width of the ski desirably is greater than that of a conventional ski. For example, where the average conventional ski may have a width of approximately 3 to 3½ inches, the ski of the present invention may have a width, particularly at its forward flexible section, of 4 to 4½ inches or somewhat greater.

In the third place, the ski of the present invention differs from skiis heretofore made and used in its flexural characteristics, viz., conventional skiis are semi-rigid in their central sections with increasing flexibility toward the tip and the tail. By contrast, it is a feature of a ski constructed in accordance with the present invention to have a flexible forward portion 10 with increasing rigidity toward the foot location area 12 and relatively constant and great rigidity between such area 12 and the heel 14 of the ski. Thus, where a conventional ski, because of its flexibility toward its tip and tail ends, can be bent in a slight arc about its central more rigid section, a ski constructed in accordance with the present invention will only bend in an arc from the foot location area 12 forward. As so constructed, it will be appreciated that the actual running surface of the ski extends from slightly forward of the lower and after terminus 16 of the forward upturned tip or shovel 11 to the heel 14 of the ski. The mid-point of this running surface is located at 24. It is with reference to point 24 that the foot location area 12 for the ski is so located as to dispose the ball of the skier's foot (indicated in dotted lines at 28).

Another distinction between a ski constructed in accordance with the present invention and similar prior art high performance skiis is the preferred elimination of any type of waist or narrowing of the ski in the foot location area as compared with the width of the ski both forward and aft of the foot location area. Thus, in its preferred construction, the ski of the present invention is widest at the base of its turned up tip section 10 with a gradual but slight narrowing of the ski back toward its tail 14.

A still further difference between a ski of the present invention and conventional skiis lies in the fact that its only camber, if any is to be provided, will be found to occur in the flexible forward shovel portion 10 with the rigid rear portion extending from the foot location area to the heel 14 of the ski being almost completely flat. A unique aspect of this invention is that in some cases, the camber in the flexible forward section may be desirably reversed thus enabling the "not so often used" flexible forward section to clear otherwise flat terrain and allowing the skier to get on with the technique for which these skiis were designed.

Yet another difference is in the significance of the last 1½ inches or so of the running surface (i.e., the tail of the ski). Since this portion is highly used and skiied upon, different designs may cause the tail to perform differently. Desirably an interchangeable tail to adapt to the needs of the skier may be provided: For example, runners to grip ice, curve for tricks, square corners or round corners, reverse hook as a stabilizer, etc. The standard tail of this invention, however, may incorporate a relatively straight turned up rear 1¼ inches which will rise approximately 3/16 inches and have slightly tapered sides. The flat surface would allow the skier to platform his turns and the slight rise will offer the necessary braking required.

It may be seen then, from the foregoing description, with reference to the drawings, that the ski of the present invention comprises an upturned tip 11, to the rear of which is a relatively flexible portion 18 of the running surface (both of which tip 11 and portion 18 comprise the forward shovel section 10), followed by a rigid section 27. The rigid section 27 may extend between the median 24, at about which full thickness of the ski is first attained, and the heel 14 of the ski. It is further intended that the foot location area 12 will be so disposed on the ski that the ball 28 of the skier's foot, through which ball the skier's weight will be applied in accomplishing turns, will be located at or in an area behind the median 24 of the running surface. Front and back releasable binding means 28,30, respectively, as shown in FIGS. 1 and 2, would then be secured to the ski releasably to hold the skier's boot on the foot location area 12. Any of the many types of releasable bindings which are currently available could be employed for this purpose although it may be necessary to adjust the bindings somewhat differently than for a conventional ski since the skier would be riding skiis of the present invention with the skier's weight disposed more toward the after part of the ski than he would with conventional skiis.

Desirably a replaceable steel heel (or an equally resistive material) plate 26 may be provided on the tail end 14 of the ski in order to take the unusual wear which will occur in this ski heel area by the use of the ski in a technique wherein turning and braking are largely effected through weight of the skier being applied to the after part of the rigid section 27 of the ski and particularly to the tail 14 thereof. This heel plate can also be changed according to the intended use and/or snow conditions.

In the embodiments of the present invention shown in FIGS. 2, 6 and 7, provision is made for elevating the heel of the skier's boot by some type of wedging means 32. In the embodiment of FIGS. 2 and 6, the wedging means may be added to the ski and secured on the top thereof. In the embodiment of FIG. 7, however, the wedge 32' may actually be formed integrally as a part of the ski. FIG. 8 illustrates a type of height-adjustable heel device 20 which might be provided.

It will be noted from FIG. 4 that the underside of the ski is so formed as to have very little curvature of the type which, in conventional skiis, provides what is termed "camber". Camber in skiis of the present invention actually is undesirable since the skier generally will be riding on the rear rigid section of the ski and irregularities on the snow surface will be countered during ski running by the flexibility of the forward flexible shovel section 10 of the ski. In many cases it is desirable to have the camber curving up rather than down, as in conventional skiis.

Because of the importance of the after section 27 of the ski being substantially rigid, FIG. 5 illustrates the preferred manner in which the body of the ski may be constructed. The heart of this ski construction comprises two parallel longitudinally extending I-beams 34,36 of an extruded polysytrene plastic. These I-beam 34,36 may be spaced a short distance from each other and are enclosed top and bottom by a plurality of sheets 38,40, respectively, of various different weaves of fiberglass cloth which have been pre-impregnated with a resin and referred to as "pre-preg". The spaces 42,44 and 46 on both sides of the I-beams and between them, respectively, are filled with an expanding urethane foam 48. Both sides of the ski are then closed by adhering plastic strips 50 to the ends of the resin-impregnated fiberglass cloths 38 and to the outer sides of the foam fillings 42 and 44. Steel edges 52 are provided to corner the bottoms of the skiis. The fiberglass cloth layers 40 are covered by a suitable running surface usually made of a urethane or similar common ski base material; and the upper fiberglass cloth layers 38 may also be covered by a plastic or suitable scratch and impact resistive plate 56. It should be pointed out that since the thickness of the shovel section 10 diminishes towards the forward end of the running surface 27,18, the I-beams 34 and 36 desirably should be tapered down from their full thickness and height, maintained in the section 27 of the running surface, to a shorter height and thickness progressively forwardly to the forward end of the flexible section 18. Thereby the latter section will become more flexible than the section 27. The actual tip area 11 may then consist of lamina of pre-preg, plastic, metal and/or rubber in order to avoid breakage under impact of moguls and other types of irregular surfaces in the snow during the running of the ski.

With the ski construction hereinabove described, it will be appreciated by those persons knowledgeable in the art of skiing that skiing with skiis of the present invention will involve quite a different technique from any of those techniques which are employed with conventional skiis. Thus, the skier's weight is disposed almost directly over the median of the relatively short running surface and turning can thus be accomplished by shifting the skier's weight to the rear of this median so that pivoting of the skiis to effect a turn and/or stop may be accomplished on the heels of the skiis, rather than near the upturned tips. The short tail section is effective as a braking and turning platform because as the skier leans back, the tails of the skiis are dug into the snow, thus causing bite or drag to take place. This has the tendency to return the skier's weight forward. In this manner a skier is no longer limited to skiing on the full side edges of his skiis, but may also have the option of skiing on the tail edges. Moreover, since the skier's weight is disposed at about the median of the running surface, or rearwardly thereof, and the rigid after section of the ski is relatively short, it is easier for the skier to dig this rigid section into the snow with the result that the more flexible forward shovel section of the ski is lifted out of the snow at an angle of attack. In this disposition of the skiis, when the skier makes his turns, he is not confronted with moving most of the forward more flexible shovel sections of the skiis through the snow in the direction of the desired turn. All that is necessary is for the skier to change the direction of the short rigid sections of the skiis and, since these sections are short and the skier's full weight is carried by them, it is relatively easy for the skier to change direction. Not only is this easier in good snow conditions, but it can be accomplished in adverse conditions of breakable crust since only a short extent of the side edges of the skiis actually come into contact with such breakable crust. Similarly, with heavy, wet snow, the skier is able with his weight shift on the short, rigid section of the ski, to effect turning.

The skiis of the present invention, therefore will be found to offer many advantages over conventional skiis, not only from the standpoint of being short enough to enable novices quickly to learn the sport, but also to enable expert skiers to ski steepest mountains, and under the most adverse snow conditions, with ease and control.

It will be appreciated by those persons knowledgeable in the art of skiis and ski construction that with skiis constructed in accordance with the present invention, a skier may ski at the highest recreational speeds with excellent control and stability and on most of the ski slopes not normally skiable by anybody! Because of the angle of attack to the snow surface and the full use of the trailing edge as a brake and turning medium, recreational skiers can enjoy such skiing without acquiring great skill or using the leg power which is typically required in skiing with skiis of conventional and prior art designs.

I claim:

1. A pair of short skiis for use by a skier employing a skiing technique wherein the skier's weight during turning and traversing of the skis by the skier is disposed principally on the heels of the skier's feet with turning and/or checking being accomplished by the skier unweighting his toes and repositioning the ski tips in the new line of direction of the desired travel, each of said skis comprising:

a relatively rigid after-section and a forwardly projecting flexible forward section turned upwardly at its front extremity to form an upturned shovel, said after and forward sections being formed with downwardly-facing flat surfaces for shifting from side-to-side on the snow to facilitate turning of said ski;

the top and bottom surfaces of said ski tapering gradually and continuously inwardly toward one another from a relatively thick aft-end to a relatively thin forward end to form a bottom surface having a continuous contour from the aft to the forward end thereof, the lateral sides of said ski further tapering inwardly and rearwardly from a relatively wide shovel to a relatively narrow aft-end;

a boot location area on each said ski, said boot location area being so disposed with reference to the total running length of the ski that the ball of the boot is disposed at the approximate median of the overall ski's total length, said flexible forward section of the ski extending from the turned-up tip section rearwardly to approximately the median of said total running length; and the total length of each ski being at least 90 centimeters and the aft-end of the boot location area is disposed so as to position the boot heel substantially 6 inches forward of the tail end of the ski.

2. A pair of skiis as described in claim 1 that includes:

binding means mounted over said boot location area and including means to dispose the heel of the skier's boot at a predetermined angular elevation above and with respect to the toe of the boot.

3. A pair of skiis as described in claim 1 wherein:

each ski includes a wear-resistive heel plate mounted on the after extremity thereof.

4. A pair of skiis as described in claim 3 that includes:

means for removably mounting said heel plate to said ski for replacement thereof for different snow conditions.

5. A pair of skiis as described in claim 1 wherein said after section is substantially rigid.

6. A pair of skiis as described in claim 2 wherein the means to elevate the heel of the skier's boot comprises a triangular wedge.

7. A pair of skiis as described in claim 2 wherein the means to maintain the heel of the skier's boot at said elevation is adjustable.

8. A pair of skiis as described in claim 1 wherein the overall length of each ski of the pair falls within the range of 90 to 110 centimeters.

9. A pair of skiis as described in claim 1 wherein the after section of each ski is substantially flat and itself without camber.

* * * * *